US009990838B1

(12) United States Patent
Yang

(10) Patent No.: US 9,990,838 B1
(45) Date of Patent: Jun. 5, 2018

(54) DIGITAL EMERGENCY SIGNAL TRANSFER SYSTEM

(71) Applicant: Yi-Lun Yang, Taipei (TW)

(72) Inventor: Yi-Lun Yang, Taipei (TW)

( * ) Notice: Subject to any disclaimer, the term of this patent is extended or adjusted under 35 U.S.C. 154(b) by 0 days. days.

(21) Appl. No.: 15/441,230

(22) Filed: Feb. 23, 2017

(51) Int. Cl.
*G08B 25/12* (2006.01)

(52) U.S. Cl.
CPC ..... *G08B 25/12* (2013.01)

(58) Field of Classification Search
None
See application file for complete search history.

(56) References Cited

U.S. PATENT DOCUMENTS 3,883,695 A * 5/1975 Bickel ..... H04M 11/04 340/502
5,521,582 A * 5/1996 Kingston ..... A61B 5/0002 340/531
5,887,067 A * 3/1999 Costa ..... G08B 3/10 381/81
8,490,129 B2 * 7/2013 Phillips ..... G08B 27/005 455/521

* cited by examiner

*Primary Examiner* — K. Wong

(57) ABSTRACT

A digital emergency signal transfer system includes a receiving terminal; the receiving terminal including at least one emergency button; when accident occurs, pressing the emergency button causing the receiving terminal to emit an emergency call to related receivers for adapting required actions; a network switch receiving signals from the receiving terminal and then converts the received emergency call into digital signals which have formats and protocol matching the protocol acceptable in the network communication; and a controller connected to the network switch by wired or wireless way; the controller serving to receive the digital signals from the network switch; then the controller emitting alert signals corresponding to the emergency signals to a plurality of electronic information device at the same time or sequentially.

11 Claims, 5 Drawing Sheets

DIGITAL EMERGENCY SIGNAL TRANSFER SYSTEM

FIELD OF THE INVENTION

The present invention is related to emergency transfer systems, and in particular to a digital emergency signal transfer system.

BACKGROUND OF THE INVENTION

In many situations, emergency buttons are installed for accidents. Conventionally these emergency buttons use analog transmission systems. However, currently digital systems are more and more popular and are widely used in many fields. However, conventional emergency buttons are not suitable for the digital system and thus are inconvenient in many practical usages.

Furthermore, conventional emergency button is a design with one button and fixed receivers so that the usages of these buttons are confined and are not suitable in current environments.

Therefore, inventor of the present invention is eager to have a new digital and multi-purposes design which can improve above mentioned defects in the prior art.

SUMMARY OF THE INVENTION

To improve the defects described above, the present invention provides a digital emergency signal transfer system, the present invention provides a the prior art analog transmission way is changed into digital transmission way so that the signals can be transferred through digital networks. The cost may be reduced greatly and the phone call does not confine by the number by the communication channels. Furthermore, by using the group unit, the calling members can be set according to the pushed emergency button and the accident occurred so that the message can be transferred effectively. However, in the prior art, the people to be informed for an occurred accident are fixed and cannot be changed based on the accident occurred, as a result, some persons that do not need to be informed are interfered.

To achieve above object, the present invention provides a digital emergency signal transfer system comprising: a receiving terminal; the receiving terminal including at least one emergency button; when accident occurs, pressing the emergency button causing the receiving terminal to emit an emergency call to related receivers for adapting required actions; a network switch receiving signals from the receiving terminal and then converts the received emergency call into digital signals which have formats and protocol matching the protocol acceptable in the network communication; and a controller connected to the network switch by wired or wireless way; the controller serving to receive the digital signals from the network switch; then the controller emitting alert signals corresponding to the emergency signals to a plurality of electronic information device at the same time or sequentially.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 5, the system of the present invention is illustrated.

A receiving terminal 10 may be a wireless or wired device (such as a telephone). The receiving terminal 10 includes at least one emergency button 11. In emergency, an operator may press the emergency button 11 to cause the receiving terminal 10 to emit an emergency call to related receivers for adapting required actions. Maybe plural emergency buttons 11 are installed for various different emergency status, such as robbing or fire accident.

A network switch 20 is one of a gateway, a router, a modem, a VoIP (voice IP), an IP phone, an Ippox, a computer or other digital devices. The network switch 20 receives signals from the receiving terminal 10 and then converts the received signals into digital signals which have formats and protocol matching the protocol acceptable in the network communication. Then in a communication network, such as ADSL, the converted digital signals are transmitted out to the succeeding devices though a repeater device, such as through a modem.

Figure 5:
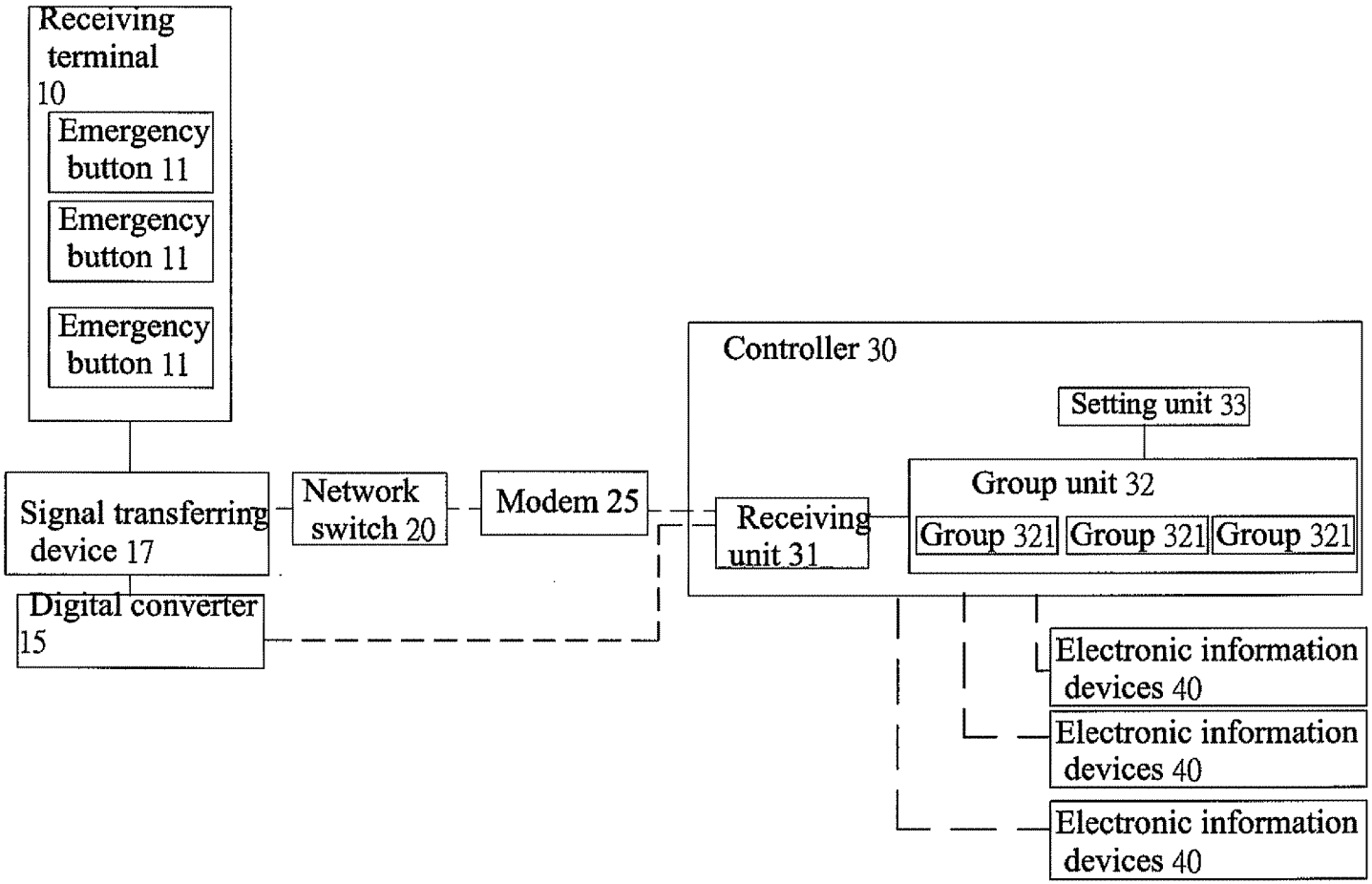
FIG. 5 is another structural view about another element of the present invention.

The receiving terminal 10 may be a digital terminal or an analog terminal. When the receiving terminal 10 is an analog terminal, as illustrated in FIG. 5, the receiving terminal 10 transfers the received analog signals to an analog signal transferring device 17 to the network switch 20 which converts data from analog data to digital data and then the signal are transferred to the controller 30 through modem 25. Or the the receiving terminal 10 transfers the received analog signals into the analog signal transferring device 17*a* and then the analog signal transferring device 17 transfers the data to an analog to digital converter 15 which further transfers the data directly to the controller 30. The analog signal transferring device 17 may be a phone or an analog transmission device.

The receiving terminal 10 may be wired or wirelessly connected to the network switch 20.

The controller 30 is connected to the network switch 20 by wired or wireless way. The controller 30 may be built in a cloud device so that people can be connected thereto.

The controller 30 serves to receive emergency signals from the network switch 20. Then messages corresponding to the emergency signals are transmitted to a plurality of electronic information device 40 at the same time or sequentially. The electronic information device 40 is selected from one of a handset, a computer, a plate computer, a phone, an alarm, a VoIP (voice IP), an IP phone, a Ippox, a gateway, or other digital device or electronic device. The electronic information device 40 may be a device capable of receiving short messages. When the receiving terminal 10 is an analog receiving terminal, the controller 30 is connected to the analog to digital converter 15 to receive digital signals from the converter.

The controller 30 comprises:

a receiving unit 31 serves for receiving the signals from the receiving terminal 10 and transferring emergency signals corresponding to the received signals.

A group unit 32 includes at least one group, in this embodiment, four groups 321, 322, 323, 324 are shown. Each group is corresponding to a specific emergency button 11 on the receiving terminal 10. The group 321 contains a list of names B, C, D, and E (see FIG. 4) of a plurality of electronic information devices 40 to be connected thereto for a received emergency signal.

When the group unit 32 receives an emergency signal from the receiving unit 31, the controller 30 finds a group 321 in the group unit corresponding to the emergency signal. Then the controller 30 emits alert signals about the emergency signal to all the electronic information devices 40 listed in the specific group 321 so that related members about the emergency events can know the messages and adapt required actions.

A setting unit 33 is connected to the group unit 32. A user can set the electronic information devices 40 listed in the group 321 of the ground unit 32 for receiving the signals about emergency events.

Figure 1:
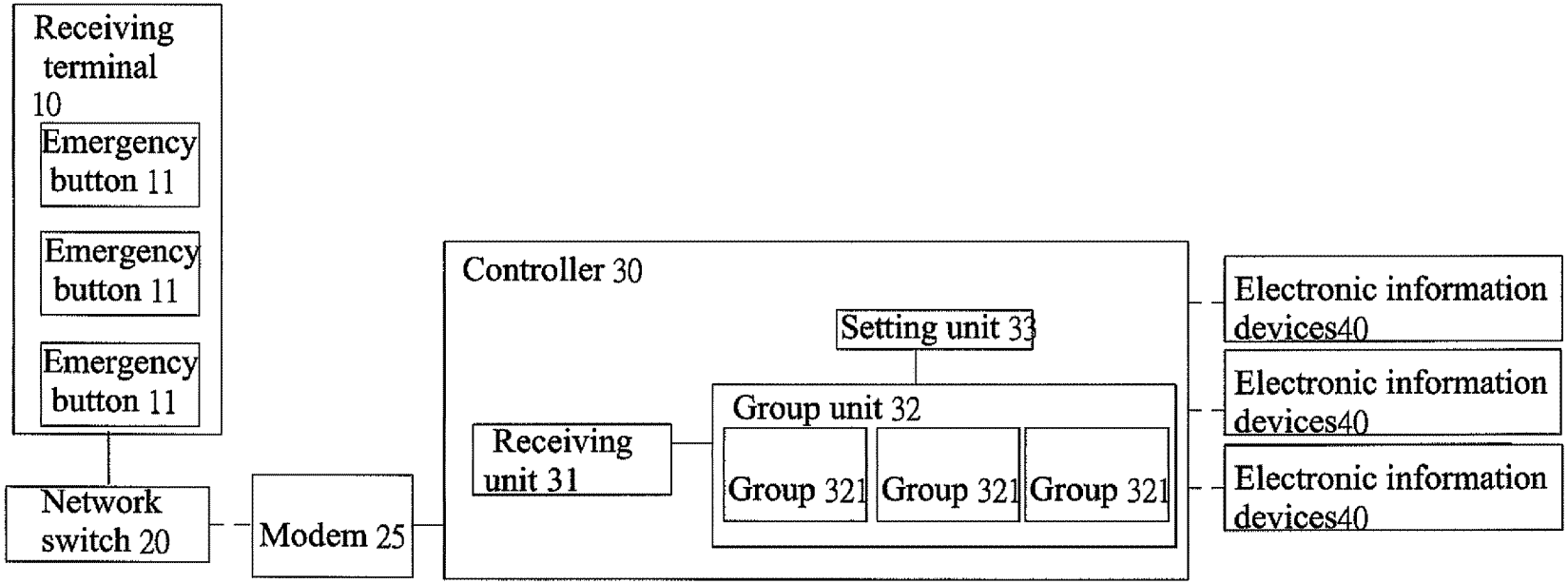
FIG. 1 shows the structural view of the present invention.
Figure 2:
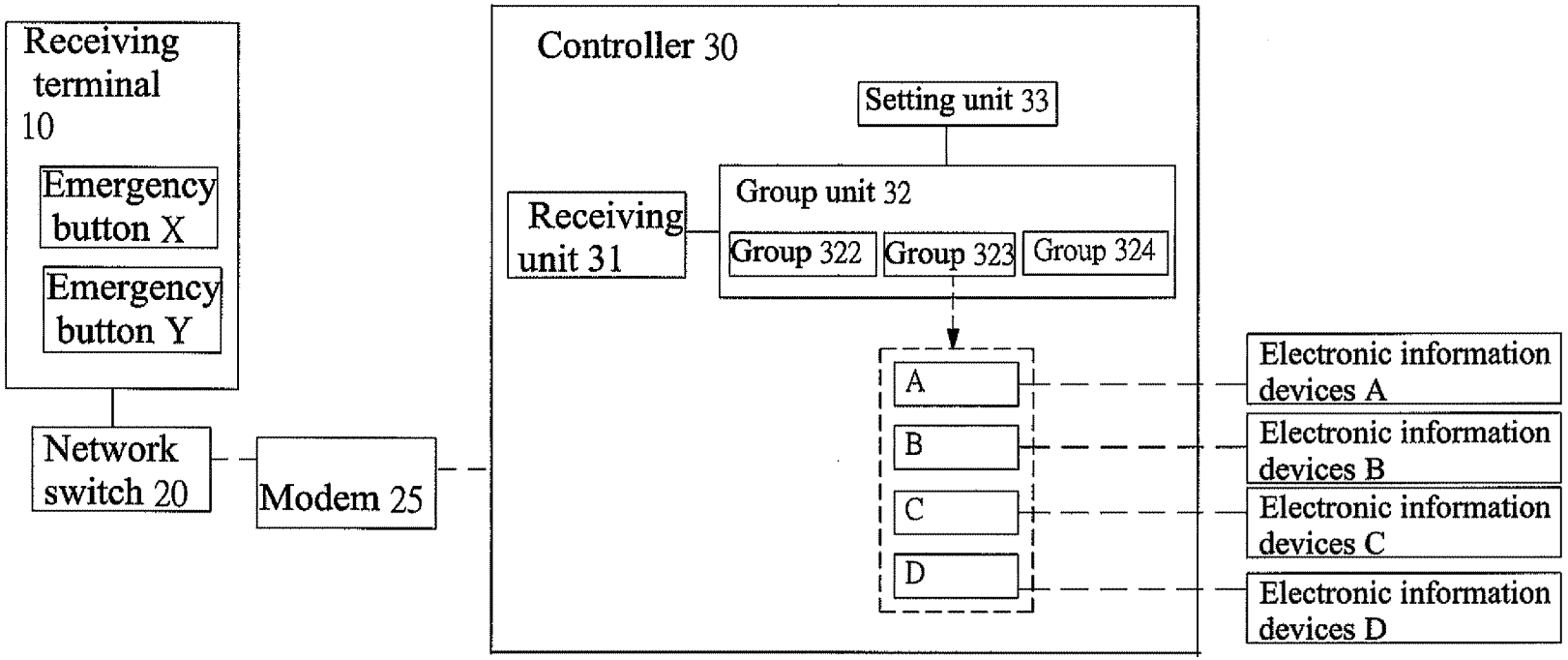
FIG. 2 shows one application of the present invention.
Figure 3:
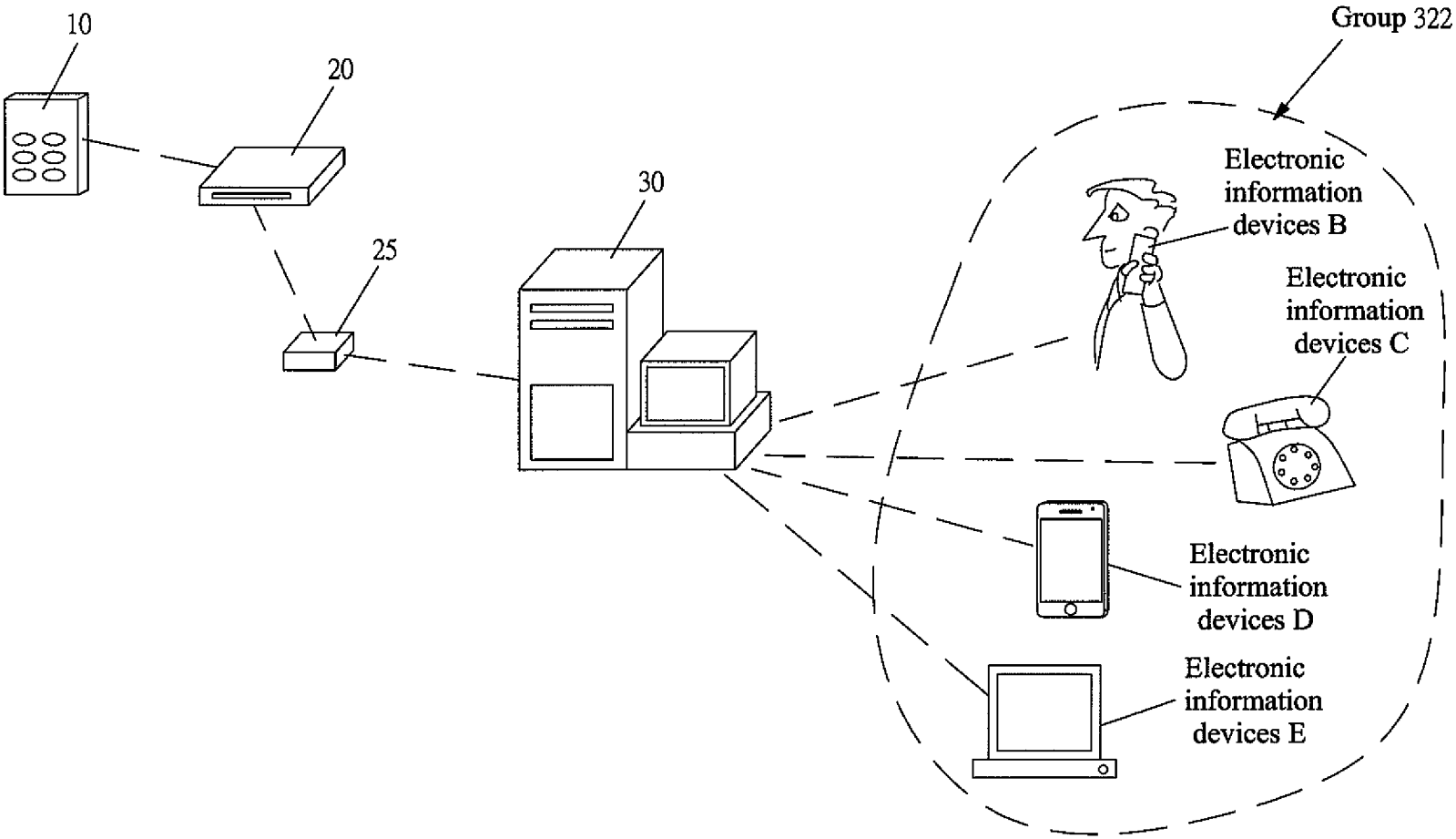
FIG. 3 shows another application of the present invention.
Figure 4:
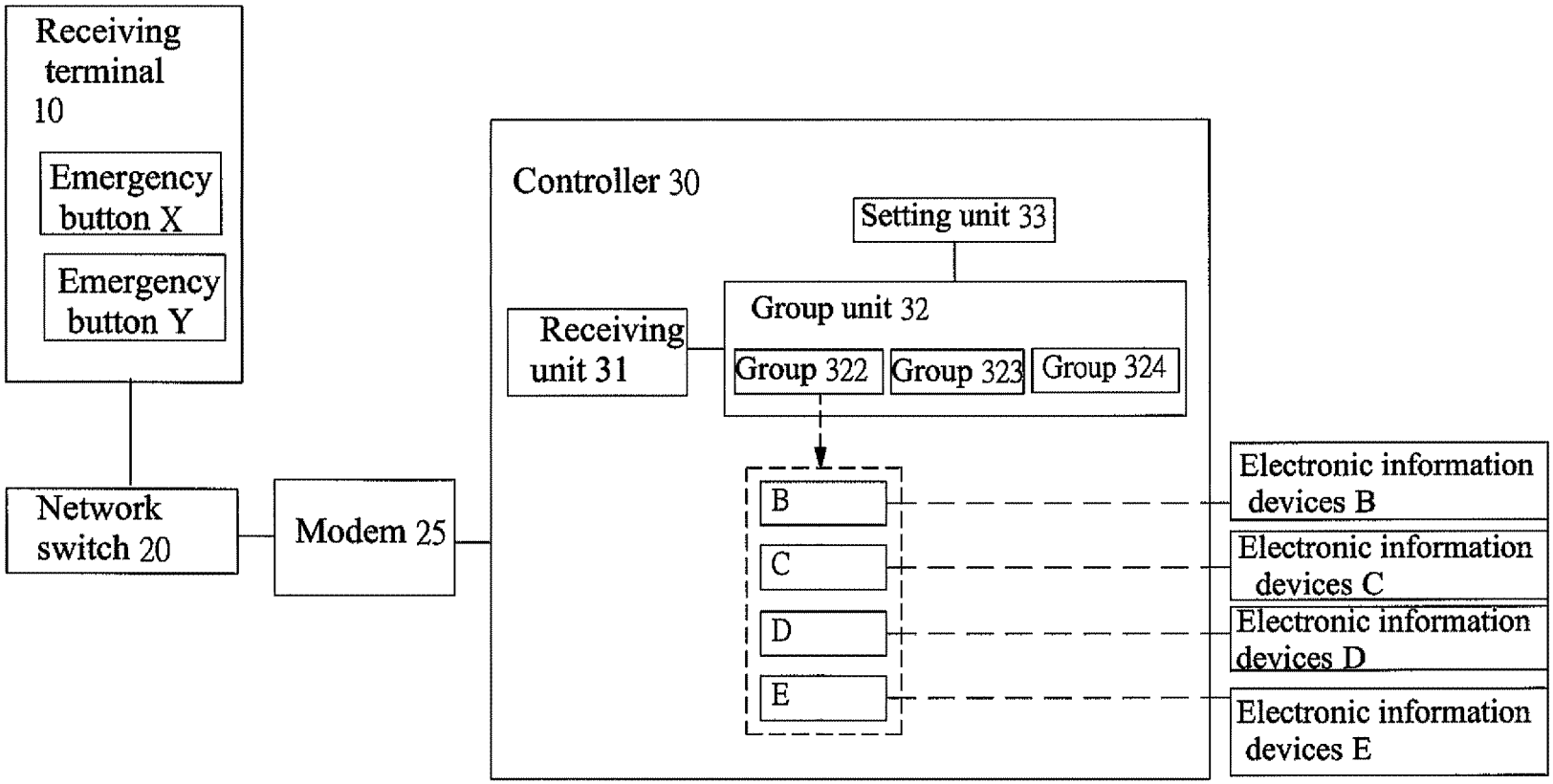
FIG. 4 shows the structure shown in FIG. 3.

FIGS. 3 and 4 show the structure of the present invention. When an emergency accident occurs, an emergency button 11 in the receiving terminal 10 can be pushed so that an emergency signal is emitted to the network switch 20. The network switch 20 is connected to the controller 30 through a modem. Then the controller 30 finds a group 322 corresponding to the emergency signal and then connects to the electronic information devices B, C, D, E set in the group 322 so that members received the signals can take necessary actions.

In the present invention, the receiving terminal 10 may contain a plurality of emergency buttons 11 which are corresponding to different accidents.

In one embodiment of the present invention, when one electronic information device 40 does not receive the call from the controller 30, the controller 30 will call it repeatedly.

In the present invention, the prior art analog transmission way is changed into digital transmission way so that the signals can be transferred through digital networks. The cost may be reduced greatly and the phone call does not confine by the number by the communication channels. Furthermore, by using the group unit, the calling members can be set according to the pushed emergency button and the accident occurred so that the message can be transferred effectively. However, in the prior art, the people to be informed for an occurred accident are fixed and cannot be changed based on the accident occurred, as a result, some persons that do not need to be informed are interfered.

In the present invention, the messages to the electronic information devices 40 can be transferred simultaneously or sequentially. If the transmission is performed simultaneously, controller 30 transfers the signals in parallel to the electronic information devices 40, instead of based on the order of the list on the group of the group unit. Therefore the speed for informing the data to all the electronic information devices 40 is quick and thus it is an effectively way.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A digital emergency signal transfer system, comprising:

a receiving terminal; the receiving terminal including at least one emergency button; when accident occurs, pressing the emergency button causing the receiving terminal to emit an emergency call to related receivers for adapting required actions;

a network switch receiving signals from the receiving terminal and then converts the received emergency call into digital signals which have formats and protocol matching the protocol acceptable in the network communication; and a controller connected to the network switch by wired or wireless way; the controller serving to receive the digital signals from the network switch; then the controller emitting alert signals corresponding to the emergency signals to a plurality of electronic information device at the same time or sequentially; and plural emergency buttons being installed on the receiving terminal for various different emergency status; and the controller comprising:

a receiving unit for receiving signals from the receiving terminal and transferring emergency signals corresponding to the received signals;

a group unit including at least one group; each group being corresponding to a specific emergency button on the receiving terminal; the group contains a list of names of a plurality of electronic information devices to be connected thereto; and wherein when the group unit receives an emergency signal from the receiving unit, the controller finds a group in the group unit corresponding to the emergency signal; then the controller emits alert signals about the emergency signal to all the electronic information devices listed in the specific group so that related members about the emergency events can know the messages and adapt required actions; and a setting unit connected to the group unit; a user can set names of the electronic information devices to the list of a specific group of the ground unit for receiving the signals about alert messages.

2. The digital emergency signal transfer system, wherein the network switch is one of a gateway, a router, a modem, a VoIP (voice IP), an IP phone, an Ippox, a computer or other digital devices.

3. The digital emergency signal transfer system as claimed in claim 1, wherein the network switch is connected to the coupling portion through at least one repeater.

4. The digital emergency signal transfer system as claimed in claim 3, wherein the repeater is a modem.

5. The digital emergency signal transfer system as claimed in claim 1, wherein the electronic information device is capable of receiving short messages; and when the receiving terminal is an analog receiving terminal, the controller is connected to the analog to digital converter to receive digital signals from the converter.

6. The digital emergency signal transfer system as claimed in claim 1, wherein the receiving terminal is wired or wirelessly connected to the network switch.

7. The digital emergency signal transfer system as claimed in claim 1, wherein the controller is built in a cloud device.

8. The digital emergency signal transfer system as claimed in claim 1, wherein the electronic information device is selected from one of a handset, a computer, a plate computer, a phone, an alarm, a VoIP (voice IP), an IP phone, a Ippox, a gateway, and other digital device or electronic device.

9. The digital emergency signal transfer system as claimed in claim 1, wherein when one electronic information device does not receive the call from the controller, the controller will call the electronic information device repeatedly.

10. The digital emergency signal transfer system as claimed in claim 1, wherein when the receiving terminal is an analog terminal, the receiving terminal transfers the received analog signals to an analog signal transferring device and then further transfers to the network switch which converts data from analog data to digital data and then the signal are transferred to the controller.

11. The digital emergency signal transfer system as claimed in claim 1, wherein when the receiving terminal is an analog terminal, the receiving terminal transfers the received analog signals into the analog signal transferring device and then the analog signal transferring device transfers the analog signal to an analog to digital converter which further transfers the data directly to the controller.

* * * * *